US007364278B2

(12) United States Patent
Kachi et al.

(10) Patent No.: US 7,364,278 B2
(45) Date of Patent: Apr. 29, 2008

(54) INKJET RECORDING APPARATUS

(75) Inventors: Yasuhiko Kachi, Kanagawa (JP); Tetsuzo Kadomatsu, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 420 days.

(21) Appl. No.: 11/068,911

(22) Filed: Mar. 2, 2005

(65) Prior Publication Data

US 2005/0195234 A1 Sep. 8, 2005

(30) Foreign Application Priority Data

Mar. 3, 2004 (JP) ..... 2004-058996

(51) Int. Cl.
*B41J 2/09* (2006.01)

(52) U.S. Cl. ..... 347/77; 347/78; 347/9

(58) Field of Classification Search ..... 347/77
See application file for complete search history.

(56) References Cited

U.S. PATENT DOCUMENTS 6,533,379 B1 * 3/2003 Kubota ..... 347/12
6,916,077 B2 * 7/2005 Eguchi et al. ..... 347/12
2003/0231232 A1 7/2005 Eguchi et al.

FOREIGN PATENT DOCUMENTS

| | | | |
|---|---|---|---|
| JP | 2-78558 | A | 3/1990 |
| JP | 6-210856 | A | 8/1994 |
| JP | 11-240158 | A | 9/1999 |
| JP | 2000-177115 | A | 6/2000 |
| JP | 2004-58649 | A | 2/2004 |

* cited by examiner

*Primary Examiner*—Matthew Luu
*Assistant Examiner*—Brian J. Goldberg
(74) *Attorney, Agent, or Firm*—Birch, Stewart, Kolasch & Birch, LLP

(57) ABSTRACT

The inkjet recording apparatus comprises: a recording head including a plurality of nozzles which eject a plurality of ink droplets two-dimensionally in a sub-scanning direction that is a direction of relative conveyance of a recording medium and the recording head, and in a main scanning direction that is orthogonal to the sub-scanning direction, wherein the nozzles are arranged in such a manner that, taking Pmin to be a minimum pitch of the nozzles in the sub-scanning direction, and taking Pts to be a pitch in the sub-scanning direction between the nozzles that eject ink droplets deposited adjacently in an overlapping fashion in the main scanning direction on the recording medium, a relationship Pts>Pmin is satisfied.

3 Claims, 9 Drawing Sheets

INKJET RECORDING APPARATUS

BACKGROUND OF THE INVENTION

1. Field of the Invention

The present invention relates to an inkjet recording apparatus which records images by ejecting ink droplets.

2. Description of the Related Art

In an inkjet printer which forms images by ejecting ink droplets onto a recording medium from a line head, there may be mutual interference between the ink droplets that have been deposited on the recording medium. Therefore, the ink liquid moves and the landing positions of the ink droplets are shifted, or streak-type unevenness arises. This presents significant problems in terms of image quality. More specifically, when dots are deposited in a superimposed fashion, the entire liquid droplet is present on the surface of the recording medium immediately after a first dot has landed, and upon landing, the liquid droplet on the surface starts to permeate into the image receiving layer of the recording medium. Provided that a second dot is ejected so as to land after the first dot has permeated completely into the medium, then there will be no merging of mixing of the respective droplets of the first and second dots, on the surface of the recording medium. However, if the second dot is ejected so as to land before the first dot has permeated completely, then cases may occur where the respective droplets of the first and second dots merge and mix on the surface of the recording medium, and hence the shape of the droplets of the dots on the surface of the recording medium is disturbed. Therefore, the prescribed dot shape becomes distorted and this can give rise to image deterioration. The merging and mixing of the droplets of respective dots that have been ejected onto the surface of a recording medium in this way is hereinafter referred to as "landing interference".

Japanese Patent Application Publication No. 2000-177115 discloses that landing interference is prevented in the direction of conveyance of paper forming a recording medium, in other words, the sub-scanning direction, by bending the ink droplets ejected from a line head, in a direction that is perpendicular to the sub-scanning direction, in other words, the main scanning direction. Although the technology in Japanese Patent Application Publication No. 2000-177115 may prevent landing interference in the sub-scanning direction, but it does not mention the prevention of landing interference in the main scanning direction.

SUMMARY OF THE INVENTION

The present invention has been contrived in view of such circumstances, and an object thereof is to provide an inkjet recording apparatus that can prevent landing interference in the main scanning direction.

In order to attain the aforementioned object, the present invention is directed to an inkjet recording apparatus, comprising: a recording head including a plurality of nozzles which eject a plurality of ink droplets two-dimensionally in a sub-scanning direction that is a direction of relative conveyance of a recording medium and the recording head, and in a main scanning direction that is orthogonal to the sub-scanning direction, wherein the nozzles are arranged in such a manner that, taking Pmin to be a minimum pitch of the nozzles in the sub-scanning direction, and taking Pts to be a pitch in the sub-scanning direction between the nozzles that eject ink droplets deposited adjacently in an overlapping fashion in the main scanning direction on the recording medium, a relationship Pts>Pmin is satisfied.

According to the present invention, the nozzles are arranged in such a manner that the pitch Pts between the nozzles which eject ink droplets that are deposited adjacently in a superimposed fashion in the main scanning direction satisfies the relationship Pts>Pmin, where Pmin is the minimum pitch of the nozzles in the sub-scanning direction. In other words, it is possible to ensure that the interval between the nozzles which eject ink droplets that are deposited adjacently in a superimposed manner in the main scanning direction is greater than Pmin. Therefore, it is possible to ensure a large interval between the ejection times of ink droplets that are adjacent and mutually superimposed in the main scanning direction, and hence "landing interference" between these dots can be prevented.

Preferably, the nozzles are arranged in such a manner that, taking n to be an integer not less than 2, a relationship Pts=n×Pmin is satisfied. According to this, the nozzles are arranged in such a manner that the pitch in the sub-scanning direction between nozzles which eject ink droplets that are deposited on the recording medium adjacently in a superimposed fashion in the main scanning direction, is n×Pmin, and hence the drive timing of the recording head is simple to control.

Preferably, the nozzles that eject ink droplets deposited adjacently in an overlapping fashion in the main scanning direction on the recording medium are separately arranged in different straight lines having substantially same prescribed inclination with respect to the main scanning direction. According to this, nozzles which eject ink droplets that are deposited adjacently in a superimposed fashion are separated from each other by the distance between the different straight lines in approximately the sub-scanning direction, and hence the intervals between the ejection times of these nozzles can be ensured. Furthermore, since the nozzles are simply arranged by being separately arranged in different straight lines, the nozzle arrangement is straightforward. A plurality of straight lines is preferably provided, and more preferably the number of straight lines is two, since this allows the nozzles to be arranged in a manner as not to cause the recording head to increase in size.

Preferably, the inkjet recording apparatus further comprises a flight deflecting device which deflects a direction of flight of each of the ink droplets ejected from the nozzles, in order that landing positions of the ink droplets on the recording medium are moved by a prescribed distance L with respect to the main scanning direction, from positions on the recording medium opposing the nozzles. According to this, the landing positions of the ink droplets are deflected through a prescribed distance L in the main scanning direction. Therefore, there is very little danger of respective ink droplets ejected by the same nozzle being mutually adjacent in the sub-scanning direction and interfering with each other.

Preferably, taking Ptm to be a minimum pitch in the main scanning direction between the ink droplets deposited on the recording medium, and taking n to be an integer not less than 2, the prescribed distance L is expressed by L=n×Ptm. According to this, the ink droplets ejected from the nozzles are deflected in the main scanning direction by n times the minimum pitch between the dots in the main scanning direction (where n is an integer of 2 or greater). As the value of n increases, the risk of respective ink droplets ejected by the same nozzle being mutually adjacent in an oblique direction and causing landing interference, becomes extremely small.

According to the invention as described above, taking the minimum pitch of the nozzles in the sub-scanning direction to be Pmin, the nozzles are arranged in such a manner that that pitch Pts between nozzles which eject ink droplets that are deposited adjacently in a superimposed fashion in the main scanning direction is Pts>Pmin. In other words, it is possible to ensure a large interval between nozzles which eject ink droplets that are adjacent and mutually overlapping in the main scanning direction. Therefore, an interval can be ensured between the ink droplet ejection times for adjacent, mutually overlapping dots in the main scanning direction, and hence landing interference between these dots can be prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment of the Present Invention

Figure 1:
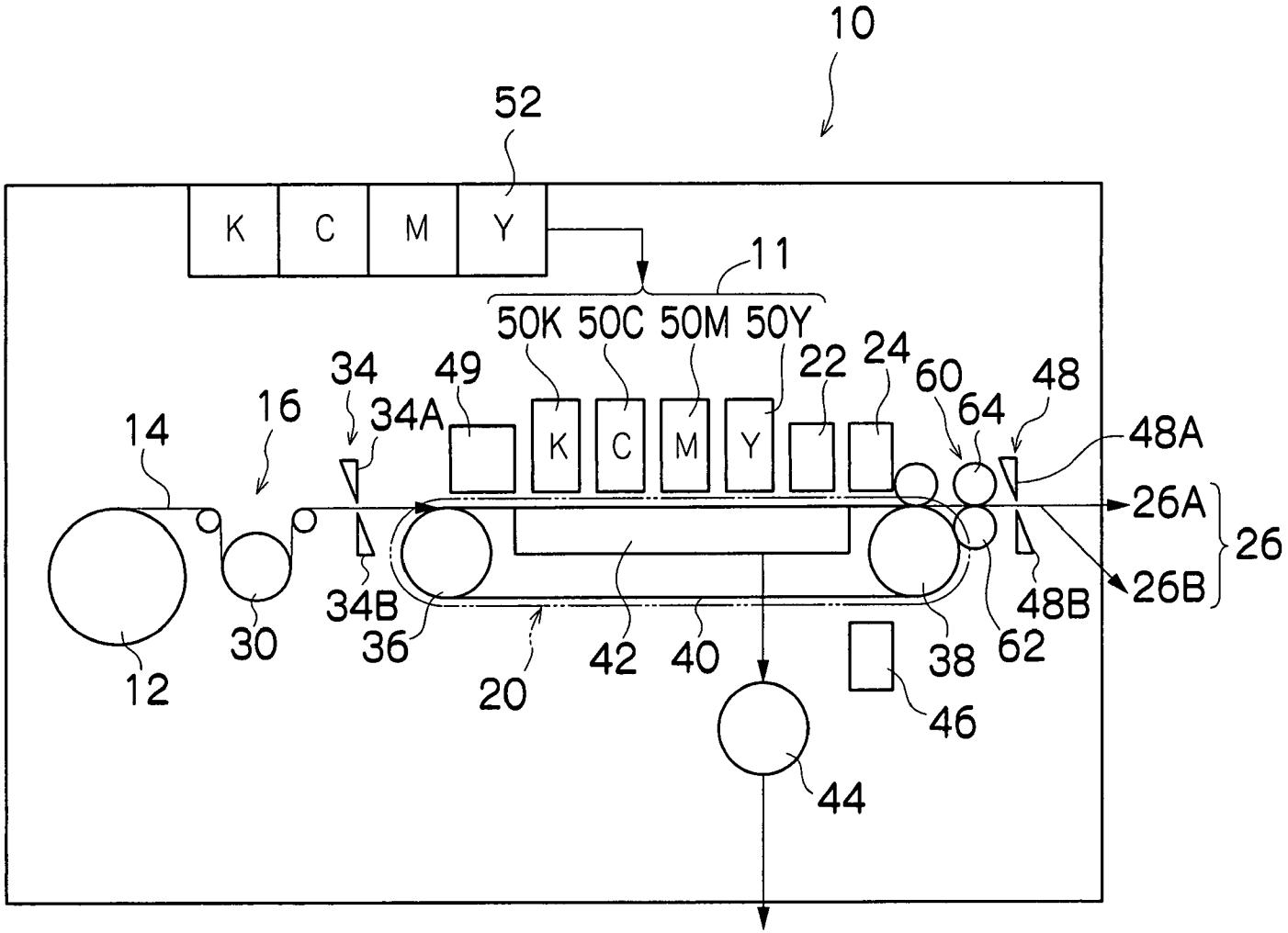
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 is a printer for recording the data of an image and the like by ejecting ink droplets onto recording paper 14, and comprises: a paper supply unit 12 for supplying the recording paper 14; a decurling unit 16 for removing curl in the recording paper 14; a printing unit 11 for recording the image data on the recording paper 14 by ejecting ink droplet from a plurality of print heads 50K, 50C, 50M, and 50Y for ink colors of black (K), cyan (C), magenta (M), and yellow (Y), respectively; a suction belt conveyance unit 20 disposed facing the nozzle face (ink-droplet ejection face) of the print unit 11, for conveying the recording paper 14 while keeping the recording paper 14 flat; a print determination unit 22 for reading the printed result produced by the printing unit 11; a post-drying unit 24 for performing after treatment to image-printed recording paper 14; and a paper output unit 26 for outputting the image-printed recording paper 14 to the exterior.

In FIG. 1, a magazine for rolled paper (continuous paper) is shown as an example of the paper supply unit 12; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of the recording paper 14 to be used is automatically determined, and ink-droplet ejection is controlled so that the ink-droplets are ejected in an appropriate manner in accordance with the type of the recording paper 14.

In the case of the configuration in which roll paper is used, a cutter (first cutter) 34 is provided as shown in FIG. 1, and the continuous paper is cut into a desired size by the cutter 34. The cutter 34 has a stationary blade 34A, whose length is equal to or greater than the width of the conveyor pathway of the recording paper 14, and a round blade 34B, which moves along the stationary blade 34A. The stationary blade 34A is disposed on the reverse side of the printed surface of the recording paper 14, and the round blade 34B is disposed on the printed surface side across the conveyor pathway. When cut paper is used, the cutter 34 is not required.

The recording paper 14 delivered from the paper supply unit 12 retains curl due to having been loaded in the magazine. In order to remove the curl, heat is applied to the recording paper 14 in the decurling unit 16 by a heating drum 30 in the direction opposite from the curl direction in the magazine. The heating temperature at this time is preferably controlled so that the recording paper 14 has a curl in which the surface on which the print is to be made is slightly round outward.

The decurled and cut recording paper 14 is delivered to the suction belt conveyance unit 20. The suction belt conveyance unit 20 has a configuration in which an endless belt 40 is set around rollers 36 and 38 so that the portion of the endless belt 40 facing at least the nozzle face of the printing unit 11 and the sensor face of the print determination unit 22 forms a horizontal plane (flat plane).

The belt 40 has a width that is greater than the width of the recording paper 14, and a plurality of suction apertures (not shown) are formed on the belt surface. A suction chamber 42 is disposed in a position facing the sensor surface of the print determination unit 22 and the nozzle surface of the printing unit 11 on the interior side of the belt 40, which is set around the rollers 36 and 38, as shown in FIG. 1; and the suction chamber 42 provides suction with a fan 44 to generate a negative pressure, and the recording paper 14 is held on the belt 40 by suction.

The belt 40 is driven in the clockwise direction in FIG. 1 by the motive force of a motor 214 (not shown in FIG. 1, but shown in FIG. 5) being transmitted to at least one of the rollers 36 and 38, which the belt 40 is set around, and the recording paper 14 held on the belt 40 is conveyed from left to right in FIG. 1.

Since ink adheres to the belt 40 when a marginless print job or the like is performed, a belt-cleaning unit 46 is disposed in a predetermined position (a suitable position outside the printing area) on the exterior side of the belt 40. Although the details of the configuration of the belt-cleaning unit 46 are not depicted, examples thereof include a configuration in which the belt 40 is nipped with a cleaning roller such as a brush roller and a water absorbent roller, an air blow configuration in which clean air is blown onto the belt 40, or a combination of these. In the case of the configuration in which the belt 40 is nipped with the cleaning roller, it is preferable to make the line velocity of the cleaning roller different than that of the belt 40 to improve the cleaning effect.

The inkjet recording apparatus 10 can comprise a roller nip conveyance mechanism, in which the recording paper 14 is pinched and conveyed with nip rollers, instead of the suction belt conveyance unit 20. However, there is a drawback in the roller nip conveyance mechanism that the print tends to be smeared when the printing area is conveyed by the roller nip action because the nip roller makes contact with the printed surface of the recording paper 14 immediately after printing. Therefore, the suction belt conveyance in which nothing comes into contact with the image surface in the printing area of the recording paper 14 is preferable.

A heating fan 49 is disposed on the upstream side of the printing unit 11 in the conveyance pathway formed by the suction belt conveyance unit 20. The heating fan 49 blows heated air onto the recording paper 14 to heat the recording paper 14 immediately before printing so that the ink deposited on the recording paper 14 dries more easily.

The printing unit 11 forms a so-called full-line head in which the print heads 50K, 50C, 50M, and 50Y (a line head) having a length that corresponds to the maximum paper width is disposed in the main scanning direction perpendicular to the paper conveyance direction (sub-scanning direction).

Although the structure is later described in detail, each of the print heads 50K, 50C, 50M, and 50Y is composed of a line head, in which a plurality of ink-droplet ejection apertures (nozzles) are arranged along a length that exceeds at least one side of the maximum-size recording paper 14 intended for use in the inkjet recording apparatus 10. The print heads 50K, 50C, 50M, and 50Y are arranged in the order of black (K), cyan (C), magenta (M), and yellow (Y) from the upstream side along the paper conveyance direction. A color print can be formed on the recording paper 14 by ejecting the inks from the print heads 50K, 50C, 50M, and 50Y, respectively, onto the recording paper 14 while conveying the recording paper 14.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing/loading unit 52 has tanks for storing the inks to be supplied to the print heads 50K, 50C, 50M, and 50Y, and the tanks are connected to the print heads 50K, 50C, 50M, and 50Y through channels (not shown), respectively. The ink storing/loading unit 52 has a warning device (e.g., a display device, an alarm sound generator) for warning when the remaining amount of any ink is low, and has a mechanism for preventing loading errors among the colors.

The print determination unit 22 has an image sensor for capturing an image of the ink-droplet deposition result of the print unit 11, and functions as a device to check for ejection defects such as clogs of the nozzles in the print unit 11 from the ink-droplet deposition results evaluated by the image sensor (line sensor). The print determination unit 22 is configured with at least a line sensor having a row of photoelectric transducing elements with a width that is greater than the ink-droplet ejection width (image recording width) of the print heads 50K, 50C, 50M, and 50Y.

A post-drying unit 24 is disposed following the print determination unit 22. The post-drying unit 24 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 60 presses the image surface with a pressure roller 62 and 64 having a predetermined uneven surface shape while heating to the image surface, and transfers the uneven shape to the image surface, so that controls the glossiness of the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 34 described above, and has a stationary blade 48A and a round blade 48B.

Although not shown in the diagram, a sorter for collecting prints according to print orders is provided to the paper output unit 26A for the target prints. Additionally, the numeral 26B in FIG. 1 is test printed-paper output unit.

Figure 2A:
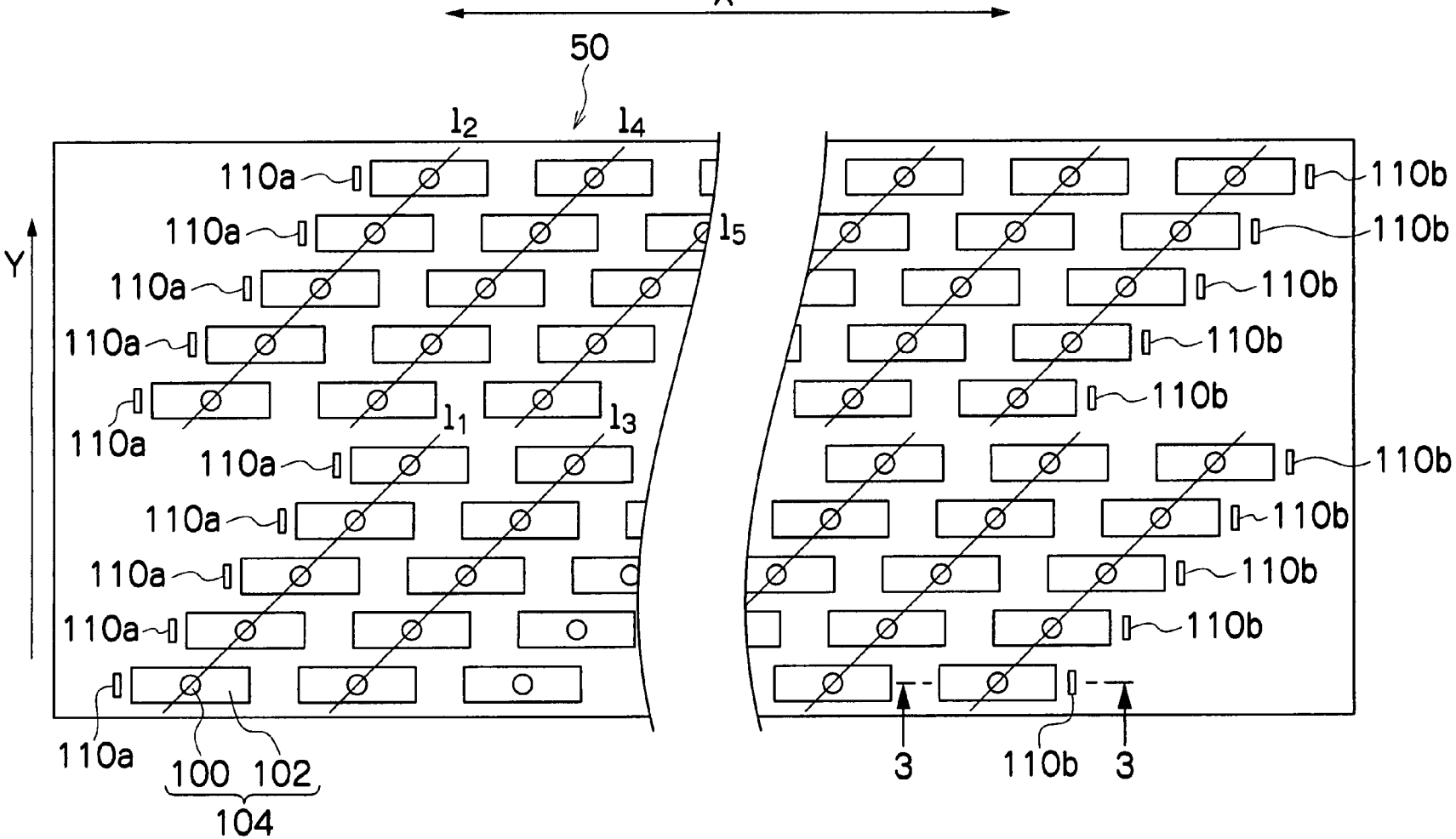
FIG. 2A is a perspective plan view showing an example of the configuration of a print head.

Next, the structure of the print heads is described. The print heads 50K, 50C, 50M and 50Y for the respective colors have the same structure, and a reference numeral 50 is hereinafter designated to any of the print heads 50K, 50C, 50M and 50Y FIG. 2A is a plan view perspective diagram showing an example of the structure of a print head 50. In order to achieve a high density of the dot pitch printed onto the surface of the recording medium, it is necessary to achieve a high density of the nozzle pitch in the print head 50. As shown in FIG. 2A, the print head 50 has a structure in which a plurality of ink chamber units 104, each including a nozzle 100 ejecting ink droplets and a pressure chamber 102 corresponding to each nozzle 100, are arranged in such a manner that the nozzles 100 are aligned in straight lines $l_1$, $l_2$, . . . .

As shown in FIG. 2A, the print head 50 in the present embodiment is a full-line head having one or more nozzle rows in which the ink ejecting nozzles 100 are arranged through a length corresponding to the entire width of the print medium in the direction X (hereafter, called the main scanning direction) substantially perpendicular to the conveyance direction of the print medium Y (hereafter, called the sub-scanning direction). Electrodes 110*a* and 110*b* are installed respectively at the ends of one nozzle row in the X direction, in such a manner that they are situated on either side of the nozzles 100 of the ink chamber unit 104.

The electrodes 110*a* and 110*b* can be divided into groups of several blocks corresponding to the nozzle rows arranged in the main scanning direction, these groups being placed at the respective ends of each nozzle block, then it is possible to ensure prescribed electric field intensity.

Figure 2B:
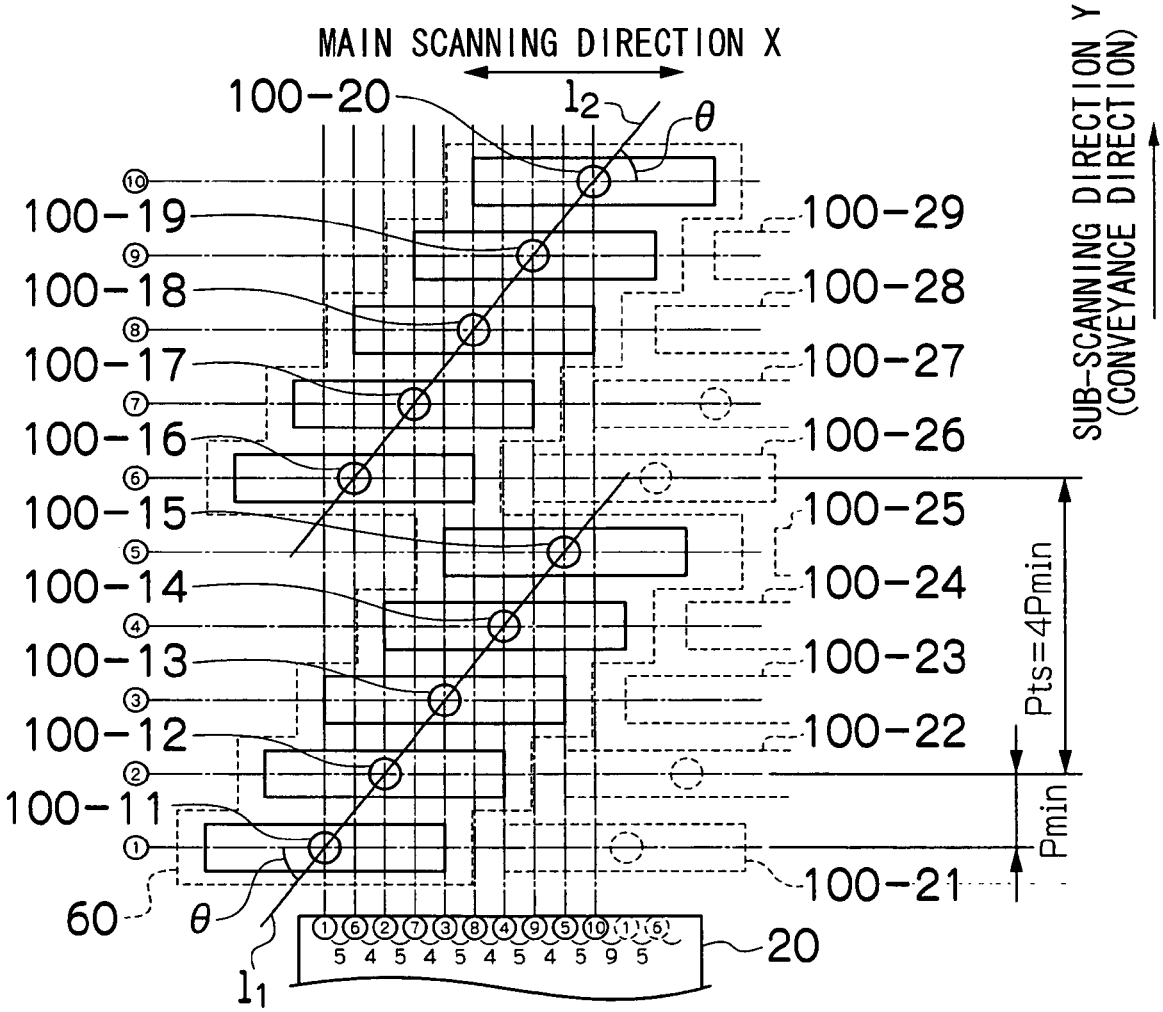
FIG. 2B is an enlarged view of a print head having a plurality of nozzles ejecting ink of the same color.

FIG. 2B is an enlarged view of the print head having the plurality of nozzles 100 that eject ink of the same color. The nozzles 100-11, 100-12, . . . , 100-20 in one block are arranged at a uniform pitch d and are separately arranged into two straight lines $l_1$ and $l_2$ having a uniform non-right angle θ with respect to a straight line parallel to the main scanning direction X. Consequently, the nozzles 100-11 to 100-15 and 100-16 to 100-20 contained in one block are positioned respectively at a uniform pitch d, substantially following the straight lines $l_1$ and $l_2$. By means of this structure, the pitch of the nozzles 100 projected to an alignment in the main scanning direction X is d×cos θ. More specifically, this configuration can be treated equivalently to one in which the respective nozzles 100 are arranged in a linear fashion at uniform pitch d×cos θ, in the main scanning direction X. By means of this composition, it is possible to achieve a nozzle composition of high density, in which the nozzle columns projected to an alignment in the main scanning direction reach a total of 2400 nozzles per inch. Below, in order to facilitate the description, it is supposed that the nozzles 100 are arranged in a linear fashion at a uniform pitch (=d×cos θ), in the lengthwise direction of the head (the main scanning direction X). In order to simplify the drawing, the nozzles 100-11, 100-12, . . . , 100-20 are indicated by solid lines, and the other nozzles 100 are depicted as broken lines. However, the nozzles 100 indicated by the broken lines are similarly arranged separately into two straight lines $l_3$, $l_4$, and the like, and are separately arranged at a uniform pitch d.

Among the nozzles 100-11, 100-12, . . . , 100-20, the pitch between the nozzles 100 ejecting ink dots 1 to 10 (hereafter, called "dots") that are deposited adjacently in an overlapping manner in the main scanning direction X is set in the sub-scanning direction Y to 4d×sin θ or 5d×sin θ, as shown in FIG. 2B. On the other hand, the minimum pitch between the nozzles 100 in the sub-scanning direction Y (for example, the pitch in the sub-scanning direction Y between the nozzle 100-11 and the nozzle 100-12) is Pmin=d×sin θ. More specifically, the pitch Pts in the sub-scanning direction Y between the nozzles 100 that eject dots which are deposited adjacently in an overlapping fashion in the main scanning direction X is at least greater than the minimum pitch Pmin between the nozzles 100 (i.e., Pts>Pmin) in the sub-scanning direction Y. The pitch Pts has a minimum value of Pts=4×Pmin and a maximum value of Pts=5×Pmin. For example, the pitch in the Y direction between the nozzles 100-11 and 100-16, that respectively eject dots 1 and 6 which are deposited adjacently in an overlapping fashion in the main scanning direction X, is 5×Pmin. Furthermore, the pitch in the Y direction between the nozzles 100-16 and 100-12, that respectively eject dots 6 and 2 which are deposited adjacently in an overlapping fashion in the main scanning direction X, is 4×Pmin.

Figure 3:
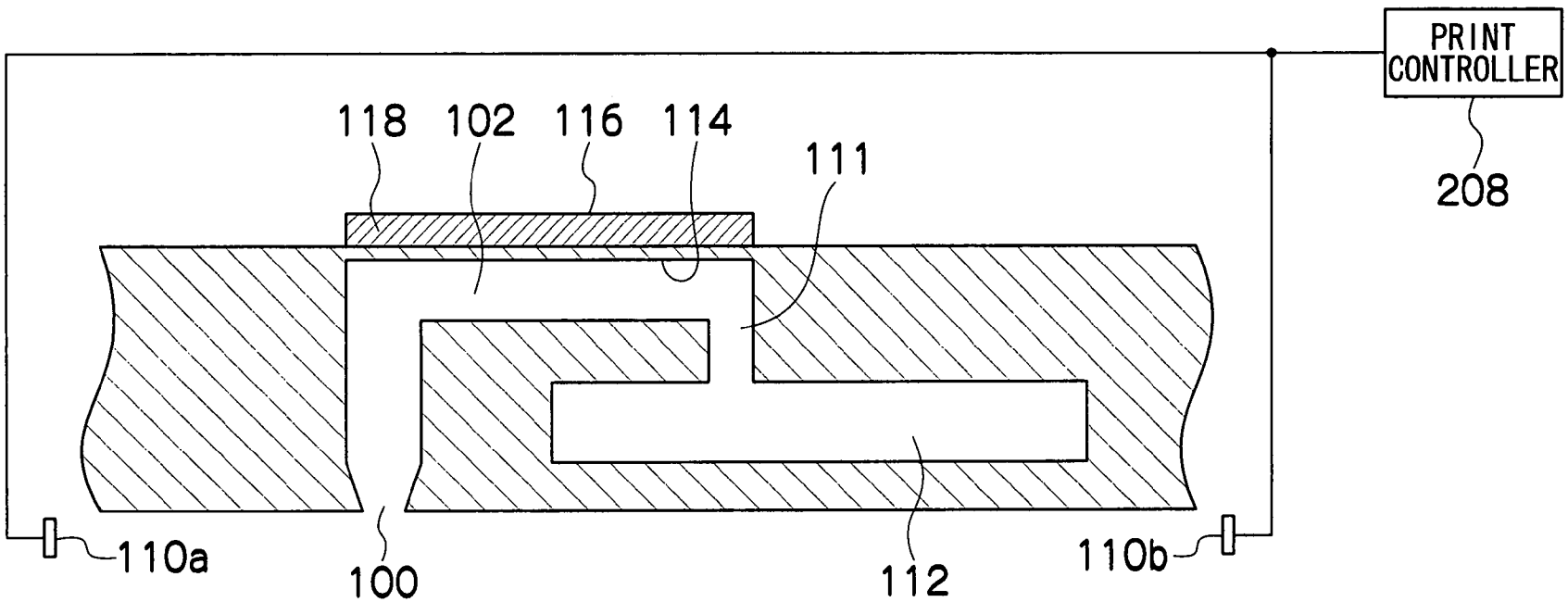
FIG. 3 is a cross-sectional view showing the three-dimensional composition of an ink chamber unit.

FIG. 3 is a cross-sectional diagram showing the three-dimensional composition of the ink chamber unit 104 (a sectional view along line 3-3 in FIG. 2A parallel to the main scanning direction). The pressure chamber 102 provided corresponding to each nozzle 100 is approximately square-shaped in plan view, and a supply port 111 is provided approximately at the center of the diagonals of the pressure chamber 102. As shown in FIG. 3, the pressure chamber 102 is connected to a common flow passage 112 via the supply port 111. An actuator 118 provided with an individual electrode 116 is joined to a pressure plate 114 which forms the ceiling of the pressure chamber 102, and the actuator 118 is deformed when a drive voltage is applied to the individual electrode 116, thereby causing ink to be ejected. When ink is ejected, new ink is supplied to the pressure chamber 102 from the common flow passage 112, via the supply port 111. The ink droplets ejected from the nozzles 100 have been electrostatically charged with a positive or negative charge.

The electrodes 110*a* and 110*b* are disposed on either side of the region of the ink ejection port of the nozzle 100. The straight line linking the electrodes 110*a* and 100*b* lies substantially in parallel with the main scanning direction X. A print controller 208 described hereafter (see FIG. 5) is connected to the electrodes 110*a* and 110*b*, and it causes an electric field of a prescribed electric field intensity to be generated between the electrodes 110*a* and 110*b*, in a direction that is substantially in parallel to the main scanning direction X. The print controller 208 applies a voltage in such a manner that the direction of the electric field generated between the electrodes 110*a* and 110*b* changes in synchronism with the printing cycle onto the recording paper 14. Accordingly, the direction in which the charged ink droplets are ejected is deflected with respect to the main scanning direction X. Below, the electrodes 110*a* and electrodes 110*b* are described jointly as electrodes 110.

When implementing the present invention, the arrangement of the nozzles is not limited to that of the example illustrated. Moreover, in the present embodiment, a method is employed in which an ink droplet is ejected by means of the deformation of the actuator 118, which is typically a piezoelectric element. However, in implementing the present invention, the method used for ejecting ink is not limited in particular, and instead of a piezo jet method, it is also possible to apply various types of methods, such as a thermal jet method where the ink is heated and bubbles are caused to form therein by means of a heat generating body such as a heater, ink droplets being ejected by means of the pressure of these bubbles.

In a full-line head having a row of nozzles which corresponds to the full width of the printing paper (recording paper 14), when the nozzles are driven, either (1), all of the nozzles are driven simultaneously, or (2) the nozzles are driven successively from one side towards the other side, or (3) the nozzles are divided up into blocks and are driven successively in these blocks, from one side towards the other. The driving of the nozzles in order to print a single line or a single band in the width direction of the printing paper (in other words, the direction X orthogonal to the direction of conveyance Y of the printing paper) is defined as main scanning.

In particular, when the nozzles 100 arranged as shown in FIG. 2A are driven, main scanning as the above-described (3) is preferred. In other words, taking the ten nozzles 100-11, 100-12, 100-13, . . . , 100-20, as one block (and taking the nozzles 100-21, 100-22, . . . , 100-29, 100-30 (not illustrated) as another block), one line is printed in the width direction of the recording paper 14 by driving the nozzles 100-11, 100-12, 100-13, . . . , 100-20 successively, in accordance with the conveyance velocity V of the recording paper 14. On the other hand, "sub-scanning" is defined as to repeatedly perform printing of one line (a line formed of a row of dots, or a line formed of a plurality of rows of dots) formed by the main scanning, while moving the full-line head and the recording paper 14 relatively to each other.

Figure 4:
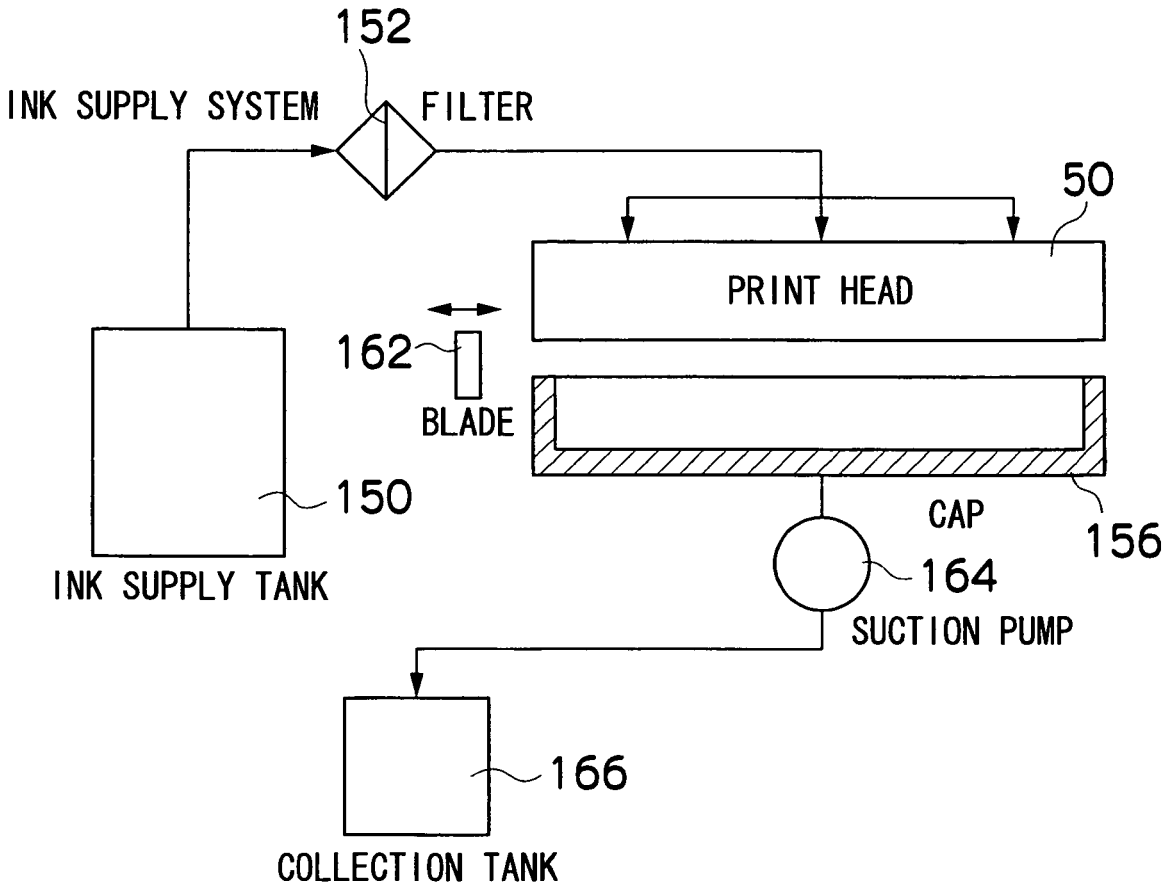
FIG. 4 is a general schematic drawing showing the composition of an ink supply system in an inkjet recording apparatus.

FIG. 4 is a conceptual diagram showing the composition of an ink supply system in the inkjet recording apparatus 10.

The ink supply tank 150 is the base tank for supplying ink, and it is disposed in the ink storing and loading unit 52 illustrated in FIG. 1. The ink supply tank 150 may adopt a system for replenishing ink by means of a replenishing opening (not illustrated), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type. The ink supply tank 150 in FIG. 4 is equivalent to the ink storing and loading unit 52 shown in FIG. 1 described above.

As shown in FIG. 4, a filter 152 is provided between the ink supply tank 150 and the print head 50, in order to remove foreign matter and bubbles. Desirably, the filter mesh size is the same as the nozzle diameter, or smaller than the nozzle diameter (generally, about 20 μm). Although not shown in FIG. 4, desirably, a composition is adopted in which a subsidiary tank is provided in the vicinity of the print head 50, or in an integrated manner with the print head 50. The subsidiary tank has the function of improving damping effects and refilling, in order to prevent variations in the internal pressure inside the head.

The inkjet recording apparatus 10 is also provided with a cap 156 as a device to prevent the nozzle 100 from drying out or to prevent an increase in the ink viscosity in the vicinity of the nozzles, and a cleaning blade 162 as a device to clean the nozzle face.

A maintenance unit including the cap 156 and the cleaning blade 162 can be moved in a relative fashion with respect to the print head 50 by a movement mechanism (not shown), and is moved from a predetermined holding position to a maintenance position below the print head 50 as required.

The cap 156 is displaced upwards and downwards in a relative fashion with respect to the print head 50 by an elevator mechanism (not shown). When the power of the inkjet recording apparatus 10 is switched off or when in a print standby state, the cap 156 is raised to a predetermined elevated position so as to come into close contact with the print head 50, and the nozzle face is thereby covered with the cap 156.

During printing or standby, if the use frequency of a particular nozzle 100 is low, and if it continues in a state of not ejecting ink for a prescribed time period or more, then the solvent of the ink in the vicinity of the nozzle evaporates and the viscosity of the ink increases. In a situation of this kind, it will become impossible to eject ink from the nozzle 100, even if the actuator 118 is operated.

Therefore, before a situation of this kind develops (namely, while the ink is within a range of viscosity which allows it to be ejected by operation of the actuator 118), the actuator 118 is operated, and a preliminary ejection ("purge", "dummy ejection" or "liquid ejection") is carried out in the direction of the cap 156 (ink receptacle), in order to expel the degraded ink (namely, the ink in the vicinity of the nozzle which has increased viscosity).

Furthermore, if bubbles enter into the ink inside the print head 50 (inside the pressure chamber 102), then even if the actuator 118 is operated, it will not be possible to eject ink from the nozzle. In a case of this kind, the cap 156 is placed on the print head 50, the ink (ink containing bubbles) inside the pressure chamber 102 is removed by suction, by means of a suction pump 164, and the ink removed by suction is then sent to a recovery tank 166. This suction operation is also carried out in order to remove degraded ink having increased viscosity (hardened ink), when ink is loaded into the head for the first time, and when the head starts to be used after having been out of use for a long period of time. The suction action is performed with respect to all of the ink in the pressure chamber 102, and hence the amount of ink consumed is considerable. Therefore, desirably, preliminary ejection is carried out in cases where the increase in the viscosity of the ink is small.

The cleaning blade 162 is composed of rubber or another elastic member, and can slide on the ink ejection surface (surface of the nozzle plate) of the print head 50 by means of a blade movement mechanism (wiper, not illustrated). If there are ink droplets or foreign matter adhering to the nozzle plate, then the nozzle plate surface is wiped by causing the cleaning blade 162 to slide over the nozzle plate, thereby cleaning the nozzle plate surface. When the soiling on the ink ejection surface has been cleaned away by means of the blade mechanism, preliminary ejection is carried out in order to prevent foreign matter from entering the nozzles 100, as a result of the blade.

Figure 5:
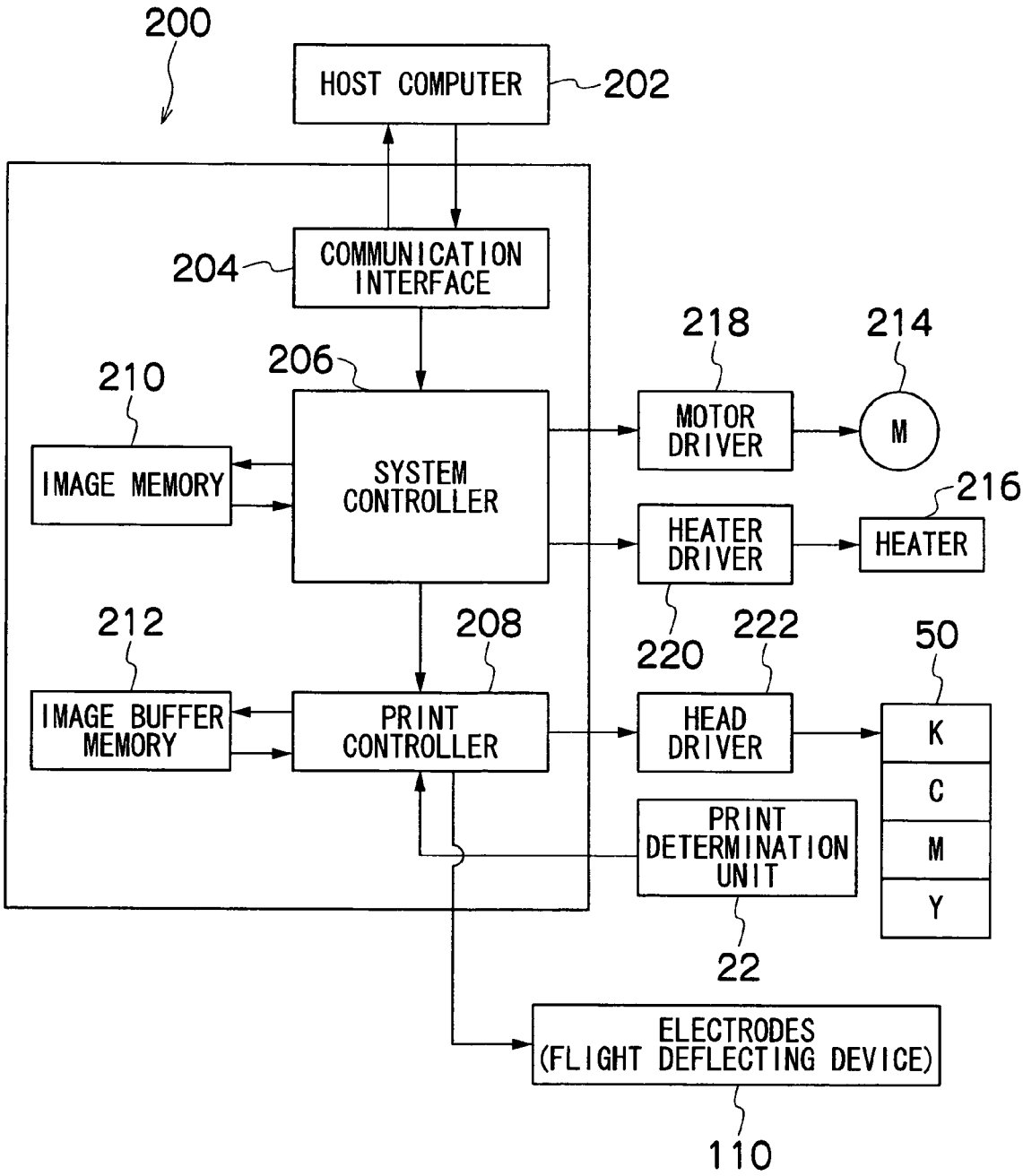
FIG. 5 is a principal block diagram showing the system composition of an inkjet recording apparatus.

FIG. 5 is a principal block diagram showing the system composition of the inkjet recording apparatus 10. A system control unit 200 of the inkjet recording apparatus 10 comprises: a communication interface 204 for acquiring data sent by a host computer 202; a system controller 206 for performing integrated control of the respective units on the basis of the image data; the print controller 208 and an image memory 210 for controlling the print heads; and an image buffer memory 212.

Image data sent from the host computer 202 is read into the inkjet recording apparatus 10 via the communication interface 204, and it is stored temporarily in the image memory 210. The image data thus read in is decompressed, and a conveyance system control signal for controlling the motor 214 of the suction belt conveyance unit 20 and the heater 216 is generated. The conveyance system control signal is supplied by the system controller 206 to the motor driver 218 and the heater driver 220.

In the print controller 208, the image data supplied from the image memory 210 is subjected to processing, such as various treatments, corrections, and the like, in order to output the image data to the print head 50. Necessary processing is carried out in the print controller 208, and the amount of ink ejected and the ejection timing in the print head 50 are controlled, via the head driver 222, on the basis of the image data. Furthermore, various corrections are made with respect to the print head 50, on the basis of information obtained from the print determination unit 22, according to requirements. Moreover, the print controller 208 controls the deflection of the direction of ejection of the ink droplets by the electrodes 110 with respect to the main scanning direction X. The image buffer memory 212 for temporarily storing image data, parameters, and the like, during image data processing, is provided in the print controller 208.

For the communication interface 204, a serial interface, such as USB, IEEE 1394, the Internet, or a wireless network, or the like, or a parallel interface, such as Centronics, or the like, can be used.

The system controller 206 may be constituted by a CPU (computing unit), an image processing IC (DSP), and a memory controller, or it may be constituted by an IC (processor) which incorporates these functions in a single chip.

A RAM is used for the image memory 210, but it is also possible to use a magnetic medium, such as a hard disk, rather than a semiconductor device.

Here, an example is described in which the image buffer memory 212 is appended to the print controller 208, but it is also possible to combine the image buffer memory 212 with the image memory 210. Furthermore, it is also possible to use a memory incorporated in the processor used for the print controller 208 as the image buffer memory 212.

The head driver 222 drives the actuators 118 (shown in FIG. 3) of the respective color heads, on the basis of the image data sent from the print control unit 208. A feedback control system for maintain uniform driving conditions in the heads may also be incorporated into the head driver 222.

The print determination unit 22 reads in the printed image, performs prescribed signal processing, and then determines the printing status, such as ejection failures, variations in droplet ejection, and the like, for each nozzle. The print determination unit 22 sends the results to the print controller 208.

Figure 2C:
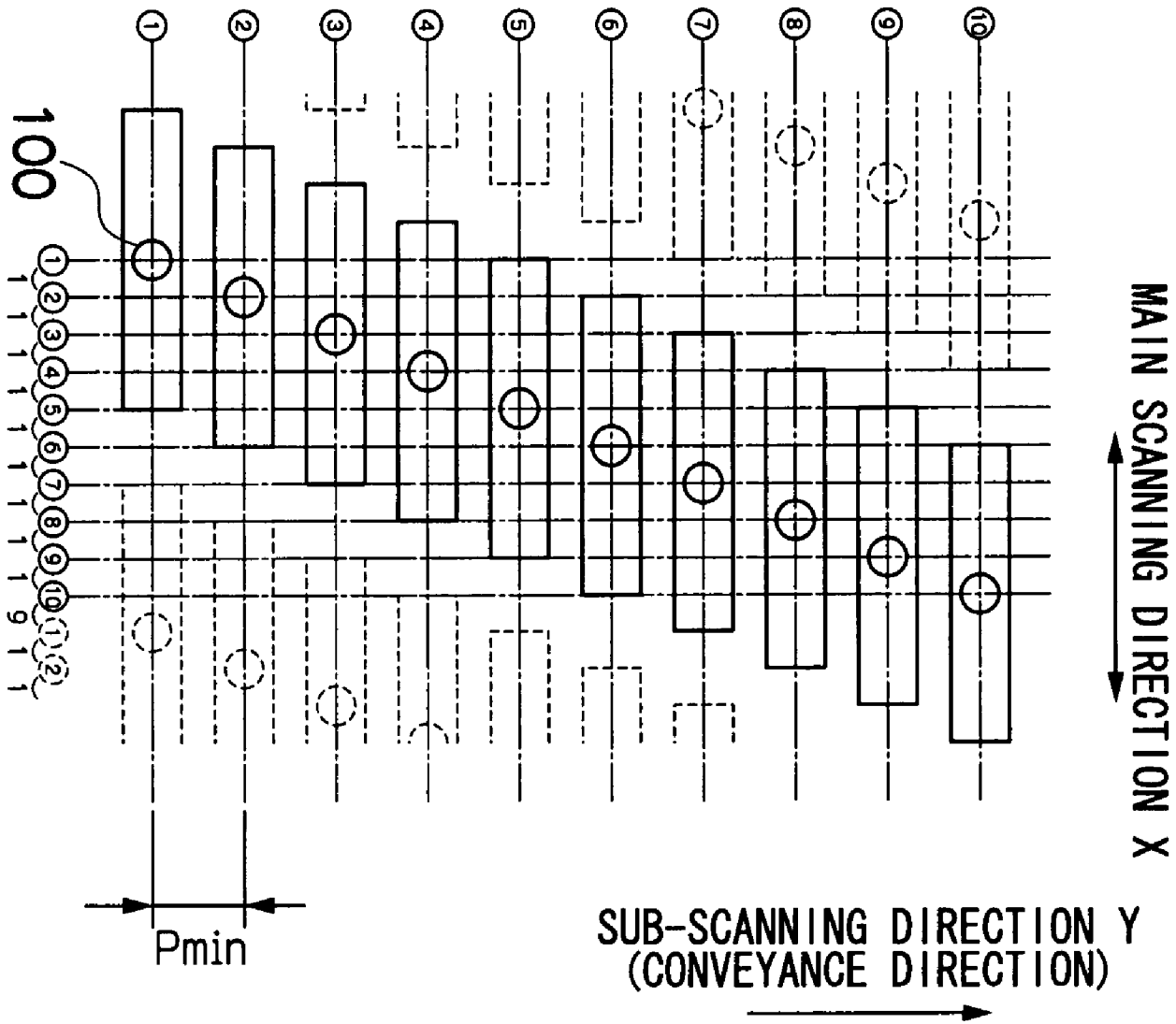
FIG. 2C is an enlarged view of a print head having nozzles arranged in a single oblique straight line.
Figure 6A:
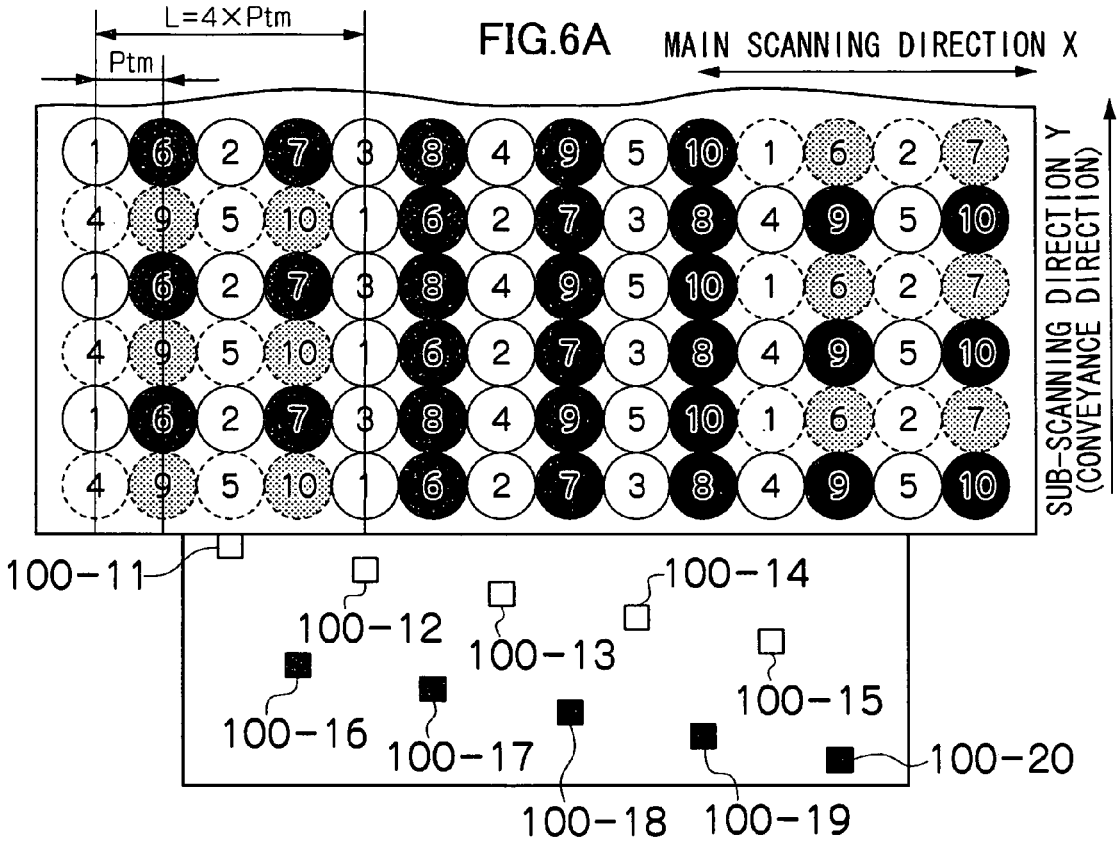
FIGS. 6A and 6B are diagrams showing an example of the pattern of ink deposition.
Figure 6B:
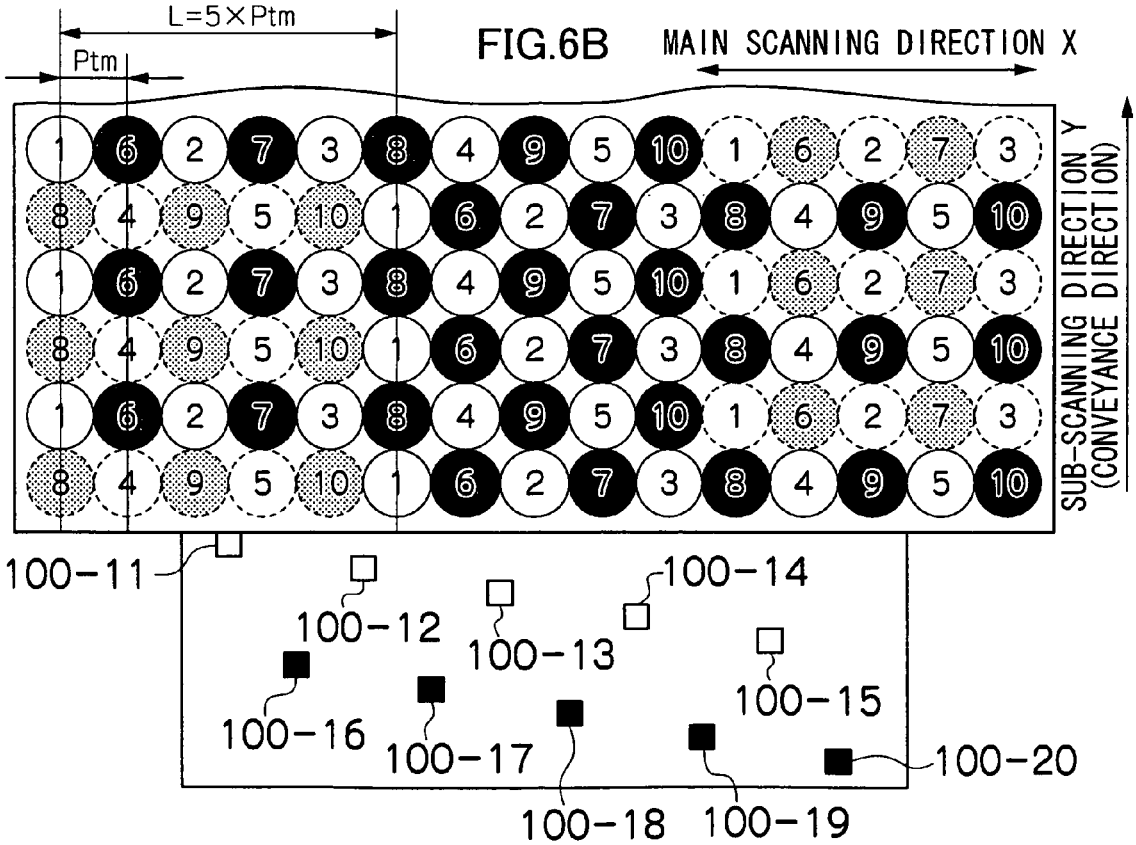

Next, one example of deposition of ink onto recording paper 14 by means of control implemented by the print controller 208 is described with reference to FIGS. 6A and 6B. FIG. 6A shows an example in which electrostatically charged ink droplets ejected from the nozzles 100 contained in one block (for example, nozzles 100-1 to 100-20) are deposited on the recording paper 14 after being deflected alternately (here, leftwards and rightwards at every two dots) by a prescribed distance L (where L=4×Ptm) in the main scanning direction X, by changing the direction of the electric field between the electrodes 110 and the electric field intensity through control of the voltage applied to the electrodes 110. As shown in FIG. 6A, the dots 1 to 10 are deposited in the sequence dot 1, dot 2, . . . , dot 10, as the recording paper 14 is conveyed in the Y direction. Here, the nozzles 100 that respectively eject droplets which are deposited adjacently in an overlapping fashion are arranged at a pitch interval of 4×Pmin or 5×Pmin in the sub-scanning direction (Y direction) as described previously. Consequently, for instance, dot 6, which is adjacent to dots 1 and 2, is deposited after the five dots 1, 2, 3, 4 and 5 have been deposited. More specifically, taking the conveyance velocity of the recording paper 14 in the Y direction to be V, then a dot that is adjacent in the X direction to an existing dot on the recording paper 14 will be deposited (ejected) at a minimum time interval of Tx=4×Pmin/V and a maximum time interval of Tx=5×Pmin/V. If the nozzle arrangement of a comparative example shown in FIG. 2C is adopted, then the time interval between the ejection of droplets which are deposited adjacently in an overlapping fashion is Pmin/V. Therefore, the present embodiment is able to ensure a time interval between the deposition of adjacent dots which is at least four times and at most five times greater than that achieved in the comparative example. Consequently, landing interference between ink droplets that are mutually adjacent in the X direction becomes less liable to occur, in comparison with the comparative example. The number of nozzles arranged following the straight lines $l_1$ and $l_2$ is not limited to 10, and any number of nozzles may be so arranged. In the case of N nozzles 100 which eject ink droplets that are deposited adjacently in an overlapping fashion in the X direction, if the nozzles 100 are arranged alternately in straight lines $l_1$ and $l_2$, then the minimum pitch of the nozzles 100 in the Y direction will be ((N/2)−1)×Pmin. Accordingly, the deposition interval between ink dots that are mutually adjacent in the X direction will be (N/2)−1 greater than that achieved in the comparative example shown in FIG. 2C, where the nozzles are arranged obliquely in a single straight line. Therefore, landing interference between the ink droplets in the X direction becomes less liable to occur. Furthermore, since N nozzles which eject ink droplets that are mutually adjacent in the X direction are simply arranged alternately in the straight lines $l_1$ and $l_2$, there is little risk of increase in the size of the line head 50 or the associated manufacturing costs, compared to a case where the nozzles are arranged obliquely in a single straight line, as in the comparative example in FIG. 2C. The number of straight lines in which the nozzles 100 in one block are separately arranged is not limited to two, as described above, and three or more straight lines may be adopted. However, arranging the nozzles 100 alternately in the straight lines $l_1$ and $l_2$ is desirable in that it enables a longer value to be ensured for the minimum Y direction pitch between nozzles 100 that eject ink droplets which are deposited adjacently in an overlapping fashion in the X direction.

Furthermore, the dots 1 to 10 are deposited onto the recording paper 14 by alternately deflecting the droplets leftwards and rightwards in the X direction, at every two dots, by controlling the electrodes 110. Droplets ejected by the same nozzle 100 and deposited are not adjacent in the Y direction and a minimum ejection time interval of Ty=2×Pmin/V can be ensured (for example, the difference between the droplet ejection times of dot 1 in the first row and dot 3 in the second row shown in FIG. 6A). In other words, since respective ink droplets ejected from the same nozzle 100 and deposited at a very short cycle are not mutually adjacent in the Y direction, landing interference is not liable to occur between the dots in the Y direction. The prescribed distance L by which the droplets are deflected in the X direction can be set as desired by altering the electric field intensity generated by the electrodes 110. By setting the distance L by which the droplets are deflected in the Y direction to L=n×Ptm (where n is an integer not less than 2), it is possible to ensure that the respective dots deposited by the same nozzle 100 are not mutually adjacent, in respect of the Y direction at least. Furthermore, by increasing the distance L, it is also possible to ensure an ejection time interval between dots which are deposited mutually adjacent in an oblique direction. For example, in FIG. 6A, the time interval Tr between the deposition of dots which are mutually adjacent in an oblique direction (such as dots 3 and 6) is 3×Pmin/V. On the other hand, by deflecting the droplets leftwards and rightwards alternately at every 2.5 dots (where L=5×Ptm), as shown in FIG. 6B, the time interval Tc between the deposition of dots that are mutually adjacent in an oblique direction (such as dots 3 and 1) will be 4×Pmin/V. Therefore, it is also possible to reduce the likelihood of landing interference between the dots which are mutually adjacent in an oblique direction. If an actual value is known for the ejection time interval Tr at which no landing interference will occur between mutually adjacent dots, then the arrangement of the nozzles and the distance L of deflection should be decided in such a manner that Tx, Ty and Tc are all greater than Tr.

Second Embodiment

As stated in the first embodiment, it is also possible to adopt a thermal jet method where the ink is heated and bubbles are caused to form therein by means of a heat generating body such as a heater, ink droplets being ejected by means of the pressure of these bubbles. In this case, a mechanism of the following type can be used instead of the electrodes 110, in order to deflect the ink droplets in the main scanning direction X.

Figure 7:
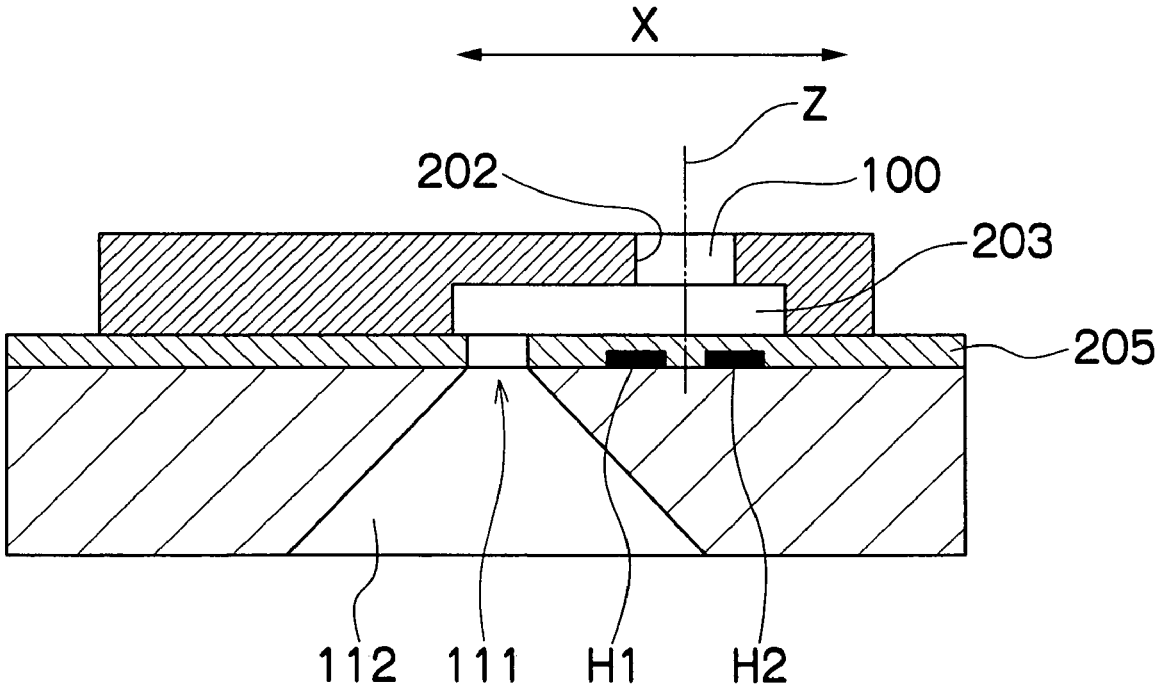
FIG. 7 is a cross-sectional diagram showing the three-dimensional composition of a thermal jet type ink chamber unit.

FIG. 7 is a cross-sectional diagram showing an ink chamber unit 104 of a thermal jet head along line 3-3 in FIG.

2A. As shown in FIG. 7, an ink flow path 203 is connected via a supply port 111 to a common flow path 112. Two heaters H1 and H2 are joined to a protective film 205 which forms the bottom face of the ink flow path 203, and these heaters are positioned on the straight line 3-3 (see FIG. 2A) which is parallel to the main scanning direction X, in such a manner that they are disposed symmetrically with respect to the center line Z of the ejection port 202 that intersects orthogonally with the main scanning direction X. By causing the heaters H1 and H2 to generate heat, small bubbles are formed on the surface of the protective film 205 above the heaters H1 and H2, and as the bubbles are growing, the ink is pushed aside and an ink droplet is ejected from the ejection port 202. When ink is ejected, new ink is supplied to the ink flow path 203 from the common flow path 112, via the supply port 111. The heaters H1 and H2 are connected to the print controller 208 of the first embodiment and the printer controller 208 performs control in such a manner that either one of the heaters H1 and H2 generates heat.

If the print controller 208 causes only the heater H1 to generate heat, then a bubble develops from the left-hand side in FIG. 7. Thereby, the ink is imparted with a velocity towards the right in the main scanning direction X, as well as a velocity in the upward direction in FIG. 7, and hence the ink is deflected towards the right in the main scanning direction X when it is ejected. On the other hand, if the print controller 208 causes only the heater H2 to generate heat, then a bubble develops from the right-hand side in FIG. 7. Thereby, the ink is imparted with a velocity towards the left in the main scanning direction X, as well as a velocity in the upward direction in FIG. 7, and hence the ink is deflected towards the left in the main scanning direction X when it is ejected. The distance L by which the ink droplet is deflected in the main scanning direction X is controlled by means of the amounts of heat generated by the heaters H1 and H2. In particular, it is desirable to set this distance L equal to n×Ptm (where n is an integer not less than 2), similarly to the first embodiment, in order that respective dots deposited by the same nozzle 100 are not mutually adjacent in the Y direction at least. In this way, by implementing control in such a manner that either one of the heaters H1 or H2 generates heat, it is possible to deflect the direction of flight of ink droplets in the main scanning direction X, by a prescribed distance L, similarly to the first embodiment.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a recording head including a nozzle block having a plurality of nozzles which eject a plurality of ink droplets two-dimensionally in a sub-scanning direction that is a direction of relative conveyance of a recording medium and the recording head, and in a main scanning direction that is orthogonal to the sub-scanning direction;

a flight deflecting device which deflects a direction of flight of each of the ink droplets ejected from the nozzles of the nozzle block, so that landing positions of the ink droplets on the recording medium are moved by a prescribed distance L with respect to the main scanning direction, from positions on the recording medium opposing the nozzles of the nozzle block; and a control device which controls the flight deflecting device such that the landing positions of the ink droplets on the recording medium are alternately moved by the prescribed distance of L for each line of the ink droplets that are ejected and deposited by the nozzles of the nozzle block, the flight of the ink droplets being controlled to align the landing positions of the droplets in the main scanning direction, where L=m×Ptm, Ptm is a minimum pitch in the main scanning direction between the ink droplets deposited on the recording medium and m is an integer not less than 2, wherein:

the nozzles of the nozzle block are arranged in such a manner that taking Pmin to be a minimum pitch of the nozzles in the sub-scanning direction, and taking Pts to be a pitch in the sub-scanning direction between the nozzles that eject ink droplets deposited adjacently in an overlapping fashion in the main scanning direction on the recording medium, a relationship Pts>Pmin is satisfied; and the nozzles of the nozzle block that eject the ink droplets deposited adjacently in the overlaying fashion in the main scanning direction on the recording medium are separately arranged in substantially parallel lines having essentially the same inclination with respect to the main scanning direction.

2. The inkjet recording apparatus as defined in claim 1, wherein the nozzles of the nozzle block are arranged in such a manner that, taking n to be an integer not less than 2, a relationship Pts=n×Pmin is satisfied.

3. A method of recording an image on a recording medium using an inkjet recording apparatus comprising:

providing a recording head which includes a nozzle block having a plurality of nozzles which eject a plurality of ink droplets two-dimensionally in a sub-scanning direction that is a direction of relative conveyance of the recording medium and the recording head, and in a main scanning direction tat is orthogonal to the sub-scanning direction; and a flight deflecting device which deflects a direction of flight of each of the ink droplets ejected from the nozzles of the nozzle block, so that landing positions of the ink droplets on the recording medium are moved by a prescribed distance L with respect to the main scanning direction, from positions on the recording medium opposing the nozzles of the nozzle block, wherein the nozzles of the nozzle block are arranged so that, taking Pmin to be a minimum pitch of the nozzles in the sub-scanning direction, and taking Pts to be a pitch in the sub-scanning direction between the nozzles that eject ink droplets deposited adjacently in an overlapping fashion in the main scanning direction on the recording medium, a relationship Pts>Pmin is satisfied; and the nozzles of the nozzle block that eject the ink droplets deposited adjacently in the overlapping fashion in the main scanning direction on the recording medium are separately arranged in at least two different straight lines having substantially same prescribed inclination with respect to the main scanning direction; and controlling the flight deflecting device to control the landing positions of the ink droplets on the recording medium so that they are alternately moved by the prescribed distance of L for each line composed of the ink droplets that are ejected and deposited by the nozzles of the nozzle block to align the landing positions of the ink droplets in the main scanning direction, where L=m×Ptm, Ptm is a minimum pitch in the main scanning direction between the ink droplets deposited on the recording medium and m is an integer not less than 2.

* * * * *